US010012041B2

(12) United States Patent
Lane

(10) Patent No.: US 10,012,041 B2
(45) **Date of Patent: *Jul. 3, 2018**

(54) DRILL ROD TALLYING SYSTEM AND METHOD

(71) Applicant: Vermeer Corporation, Pella, IA (US)

(72) Inventor: Philip R. Lane, Pella, IA (US)

(73) Assignee: Vermeer Corporation, Pella, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/657,778

(22) Filed: Jul. 24, 2017

(65) Prior Publication Data

US 2017/0321503 A1 Nov. 9, 2017

Related U.S. Application Data

(63) Continuation of application No. 14/755,978, filed on Jun. 30, 2015, now Pat. No. 9,719,314.
(Continued)

(51) Int. Cl.
*E21B 19/16* (2006.01)
*E21B 7/04* (2006.01)
*E21B 3/02* (2006.01)

(52) U.S. Cl.
CPC ..... *E21B 19/165* (2013.01); *E21B 3/02* (2013.01); *E21B 7/046* (2013.01); *E21B 19/16* (2013.01); *E21B 19/166* (2013.01)

(58) Field of Classification Search
CPC ..... E21B 19/165; E21B 19/16; E21B 19/166; E21B 19/20; E21B 19/00; E21B 3/02;
(Continued)

(56) References Cited

U.S. PATENT DOCUMENTS 4,852,665 A 8/1989 Bertrand et al.
4,976,143 A 12/1990 Casso
(Continued)

FOREIGN PATENT DOCUMENTS

CN 202510037 10/2012
CN 102808610 12/2012
(Continued)

OTHER PUBLICATIONS

File History for EP App. No. 15174777.1 as retrieved from the European Patent Office Electronic File System on Jan. 2, 2018, 182 pages.
(Continued)

*Primary Examiner* — Wei Wang
(74) *Attorney, Agent, or Firm* — Hollingsworth Davis, LLC

(57) ABSTRACT

An apparatus and method automatically tally drill string rods for use with a drilling machine. The machine comprises a rack and a rotary drive configured for longitudinal displacement between first and second longitudinal positions. A sensor system is configured to monitor the machine to detect a clamping force applied to rotationally immobilize the drill string and to detect a break-out torque generated by the rotary drive, detect a first longitudinal position of the rotary drive whereat the break-out torque is generated, and detect a second longitudinal position of the rotary drive whereat a make-up torque is generated by the rotary drive. A controller is configured to prevent release of the clamping force until the make-up torque is detected, and automatically enable release of the clamping force after the make-up torque is detected and, concordantly, to update a drill rod tally only when the first and second longitudinal positions are different.

7 Claims, 13 Drawing Sheets

Related U.S. Application Data

(60) Provisional application No. 62/019,873, filed on Jul. 1, 2014.

(58) Field of Classification Search
CPC ..... E21B 7/046; E21B 44/00; E21B 44/02; E21B 47/04; E21B 19/15
See application file for complete search history.

(56) References Cited

U.S. PATENT DOCUMENTS

| | | | |
|---|---|---|---|
| 6,491,115 | B2 | 12/2002 | Van Houwelingen et al. |
| 6,550,547 | B1 | 4/2003 | Payne et al. |
| 6,892,812 | B2 | 5/2005 | Niedemayr et al. |
| 7,428,937 | B2 | 9/2008 | Hinshaw et al. |
| 2004/0217880 | A1 | 11/2004 | Clark et al. |
| 2007/0246261 | A1* | 10/2007 | Lowe ..... E21B 19/22 175/26 |
| 2008/0125876 | A1 | 5/2008 | Boutwell |
| 2008/0240865 | A9 | 10/2008 | Hinshaw et al. |
| 2013/0068490 | A1 | 3/2013 | Wittenschlaeger |
| 2013/0341036 | A1 | 12/2013 | Flusche |
| 2014/0144707 | A1 | 5/2014 | Hartke et al. |
| 2014/0299313 | A1 | 10/2014 | Messmer et al. |
| 2016/0002989 | A1 | 1/2016 | Lane |

FOREIGN PATENT DOCUMENTS

| | | |
|---|---|---|
| CN | 101936132 | 9/2013 |
| WO | WO2011/146490 | 11/2011 |
| WO | WO2013/165943 | 11/2013 |
| WO | WO2014/007790 | 1/2014 |
| WO | WO2014000790 | 1/2014 |

OTHER PUBLICATIONS

Office Action dated Aug. 22, 2017 from CN App. No. 201510379941.5, 10 pages.

Vermeer Corporation, "Fundamentals of Horizontal Directional Drilling, User's Guide", 2004, 122 pages.

Iversen et al., "Offshore Field Test of a New System for Model Integrated Closed-Loop Drilling Control," SPE Drilling & Completion, Dec. 2009, pp. 518-530.

* cited by examiner

DRILL ROD TALLYING SYSTEM AND METHOD

RELATED PATENT DOCUMENTS

This application is a continuation of U.S. patent application Ser. No. 14/755,978, filed Jun. 30, 2015, which claims the benefit of Provisional Patent Application Ser. No. 62/019,873 filed on Jul. 1, 2014, to which priority is claimed and which are hereby incorporated herein by reference in their entireties.

SUMMARY

Embodiments are directed to an apparatus for automatically tallying drill rods of a drill string for use with a drilling machine. The machine comprises a rack and a rotary drive configured for longitudinal displacement relative to the rack between a first longitudinal position and a second longitudinal position. The drill rod tallying apparatus comprises a sensor system configured to monitor the machine to detect a clamping force applied to rotationally immobilize the drill string and to detect a break-out torque generated by the rotary drive, detect a first longitudinal position of the rotary drive whereat the break-out torque is generated, and detect a second longitudinal position of the rotary drive whereat a make-up torque is generated by the rotary drive. The rod tallying apparatus also comprises a controller configured to prevent release of the clamping force until the make-up torque is detected, and automatically enable release of the clamping force after the make-up torque is detected and, concordantly, to update a drill rod tally only when the first longitudinal position is different than the second longitudinal position.

Some embodiments are directed to a method of automatically tallying drill rods for use with a drilling machine. The method comprises monitoring the machine to detect a clamping force applied to immobilize a drill string and to detect a break-out torque generated by a rotary drive, detecting a first longitudinal position of the rotary drive at which the clamping force is applied and the break-out torque is generated, and preventing release of the clamping force until a make-up torque is generated by the rotary drive. The method also comprises detecting a second longitudinal position of the rotary drive at which the make-up torque is generated by the rotary drive, and automatically allowing release of the clamping force after the make-up torque is generated by the rotary drive and updating a drill rod tally when the first longitudinal position is different than the second longitudinal position.

Other embodiments are directed to a method of automatically tallying drill rods for use with a drilling machine. The method comprises detecting whether a rotary drive of the machine is at a first longitudinal position or at a second longitudinal position, monitoring the machine to detect a clamping force applied to immobilize a drill string and to detect a break-out torque generated by the rotary drive, and preventing release of the clamping force until a make-up torque is generated by the rotary drive. The method also comprises automatically allowing release of the clamping force after the make-up torque is generated by the rotary drive and updating a drill rod tally based on whether the make-up torque is generated with the rotary drive at the first or second longitudinal position.

Further embodiments are directed to a method of automatically tallying drill rods for use with a drilling machine. The method comprises monitoring the machine to detect a clamping force applied to immobilize a drill string and to detect a break-out torque generated by a rotary drive, and detecting a first longitudinal position of the rotary drive at which the clamping force is applied and the break-out torque is generated. The method also comprises generating a rod tally display and a torque display or audible indicator of the torque generated by the rotary drive in a rod-tightening direction. The method further comprises detecting a second longitudinal position of the rotary drive at which the torque display or audible torque indicator indicates a predetermined make-up torque has been reached, and automatically updating a drill rod tally when the first longitudinal position is different than the second longitudinal position.

Some embodiments are directed to a method of automatically tallying drill rods for use with a drilling machine. The method comprises monitoring the machine to detect a clamping force applied to immobilize a drill string and to detect a break-out torque generated by a rotary drive, detecting a first longitudinal position of the rotary drive at which the clamping force is applied and at which the break-out torque is generated, and preventing release of the clamping force until a make-up torque is generated by the rotary drive. The method also comprises detecting a second longitudinal position of the rotary drive at which a torque generated by the rotary drive reaches a predetermined make-up torque, and automatically allowing release of the clamping force after the make-up torque is generated by the rotary drive and concordantly updating a drill rod tally if the first longitudinal position is different than the second longitudinal position.

Other embodiments are directed to a method of automatically tallying drill rods for use with a drilling machine. The method comprises detecting whether a rotary drive of the machine is at a first longitudinal position or at a second longitudinal position, monitoring the machine to detect a break-out event and a make-up event, and automatically updating a drill rod tally based on detecting a combination of the break-out and make-up events. In some implementations, automatically updating the drill rod tally is based on detecting a combination of the break-out and make-up events and detecting positions where the break-out and make-up events occurred.

The above summary is not intended to describe each disclosed embodiment or every implementation of the present disclosure. The figures and the detailed description below more particularly exemplify illustrative embodiments.

BRIEF DESCRIPTION OF THE DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

In the following description of the illustrated embodiments, references are made to the accompanying drawings forming a part hereof, and in which are shown by way of illustration, various embodiments by which the invention may be practiced. It is to be understood that other embodiments may be utilized, and structural and functional changes may be made without departing from the scope of the present invention.

Systems, devices or methods according to the present invention may include one or more of the features, structures, methods, or combinations thereof described herein. For example, a device or system may be implemented to include one or more of the advantageous features and/or processes described below. It is intended that such a device or system need not include all of the features described herein, but may be implemented to include selected features that provide for useful structures, systems, and/or functionality.

Embodiments of the disclosure are directed to systems and methods for accurately tallying drill rods of a drill string. Embodiments of the disclosure are directed to systems and methods for accurately incrementing and decrementing a drill rod tally only when a drill rod is actually added to or removed from a drill string, respectively. Drill string tallying methodologies of the present disclosure can be implemented with a variety of different drilling machines, including horizontal directional drilling machines and vertical drilling machines.

Figure 1A:
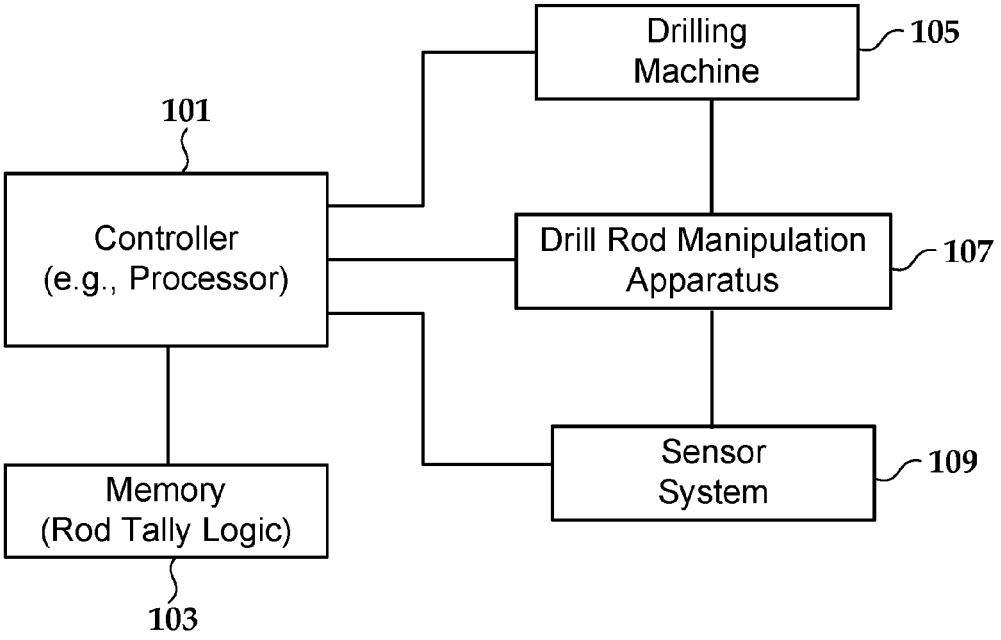
FIG. 1A illustrates various components of a system for automatically tallying drill rods of a drill string in accordance with various embodiments.

FIG. 1A illustrates various components of a system for automatically tallying drill rods of the drill string, in accordance with various embodiments. In the embodiment shown in FIG. 1A, the system includes a controller 101, which typically includes a processor or other logic device. The controller is coupled to memory 103, which is configured to implement drill rod tally logic, in accordance with various embodiments. The controller 101 is communicatively coupled to a drilling machine 105, a drill rod manipulation apparatus 107, and a sensor system 109. The drill rod manipulation apparatus 107 is configured to facilitate adding and removal of drill rods respectively to and from a drill string comprising a multiplicity of drill rods coupled together. The sensor system 109 includes various sensors provided on the drill rod manipulation apparatus 107 and the drilling machine 105. The sensors of the sensor system 109 monitor various components of the system to determine the state of the components, from which the controller 101 can coordinate rod tallying methodologies of the present disclosure.

In some embodiments, the drilling machine 105 shown in FIG. 1A is configured for horizontal directional drilling. A horizontal directional drilling machine, for example, is understood by those of ordinary skill in the drilling industry as a machine that provides directional drilling of relatively shallow (e.g., depths of less than about 20-30 feet) and predominantly horizontal bores through the earth, such as for running utilities under a roadway, for example. In other embodiments, the drilling machine 105 shown in FIG. 1A is configured for vertical drilling, which may include vertical directional drilling. In contrast to a horizontal directional drilling machine, a vertical drilling machine is understood by those of ordinary skill in the drilling industry to be a machine that provides drilling of relatively deep (e.g., hundreds or thousands of feet) and predominantly vertical bores in the earth (e.g., oil and gas wells). Although the present disclosure describes various rod tallying methodologies in the context of horizontal directional drilling, it is understood that the disclosed methodologies may be applied in the context of vertical drilling machines, including those with a directional (i.e., steering) capability.

Vertical drilling rigs have traditionally used a measure of the weight hanging on the rotation unit as an indication of when the drill string is suspended. This measure of weight appears to have historically been a primary input used to calculate drill rod length. Accordingly, vertical rigs have not relied on the make-up/break-out processes to monitor the rod count. Further, unlike horizontal directional drilling rigs, vertical drilling machines or rigs generally include devices known as slips, which are passive devices that, once installed, limit movement of a given drill string. This difference between vertical and horizontal drilling rig configuration would directly impact any rod counting logic, in that a slip is an extra system element that does not interact with the make-up/break-out processes in the same way that vises do on horizontal directional drilling rigs.

Figure 1B:
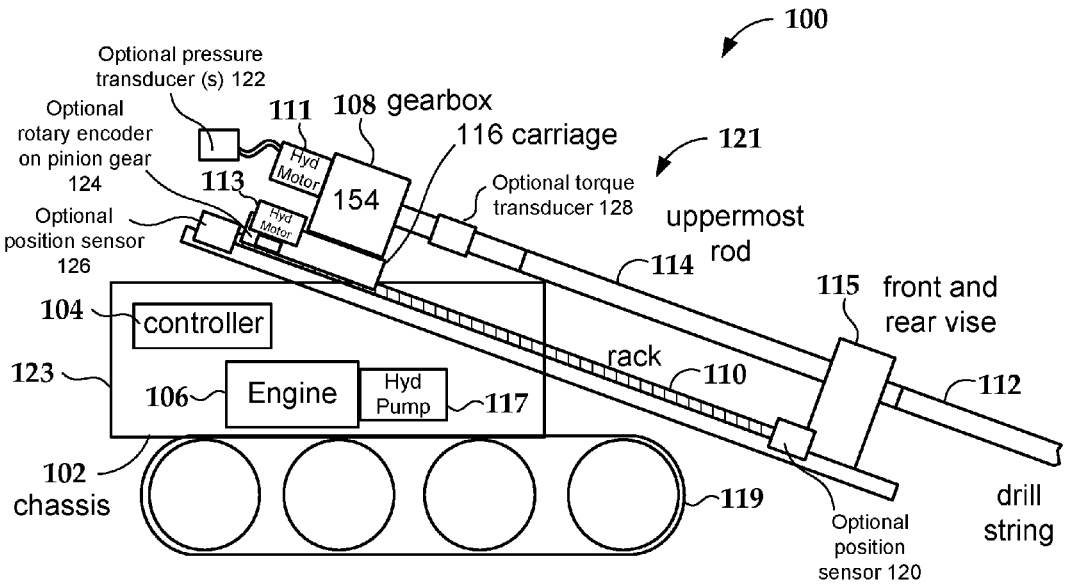
FIG. 1B illustrates a horizontal directional drilling machine which can incorporate an automatic drill rod tallying apparatus and method in accordance with various embodiments.

FIG. 1B illustrates a horizontal directional drilling machine 100, in accordance with various embodiments. The drilling machine 100, shown in FIG. 1B, includes a propulsion apparatus 123 coupled to a drill rod manipulation apparatus 121. The propulsion apparatus 123 includes an engine 106 and one or more hydraulic pumps 117 supported by a chassis 102. A track drive 119 or other drive arrangement allows the drilling machine 100 to be maneuvered around the worksite. The drill rod manipulation apparatus 120 includes a rack 110, a carriage 116, and a vise arrangement 115. The carriage 116 is configured for longitudinal displacement along the rack 110 and can travel longitudinally between a rear position, nearest the chassis 102, and a front position, nearest the vise arrangement 115. The carriage 116 supports a gearbox 108, which includes a rotary drive 154 configured to rotatably couple and decouple to and from a drill rod 114. The gearbox 108 and rotary drive 154 travel longitudinally with the carriage 116 along the rack 110. The gearbox 108 supports or is coupled to a rotation motor 111 and a displacement motor 113. In some embodiments, the rotation and displacement motors 111 and 113 are hydraulic motors.

Operation of the rotation and displacement motors 111 and 113 is monitored using one or more sensors, respectively, such as pressure transducers. In some embodiments, the rotary drive of the gearbox 108 is monitored using one or more pressure transducers 122. The longitudinal displacement of the gearbox 108 is monitored by one or more positions sensors 120, 126 and/or a rotary encoder 124 provided on a pinion gear. A pressure transducer 122, torque transducer 128 or other sensor (or combination of sensors) provides an indication of torque produced by the rotary drive 154 of the gearbox 108. It is understood that one or more sensors can be used to measure torque directly or indirectly (e.g., a sensor that senses a parameter like fluid pressure that can be correlated to torque). In some embodiments, one or more torque thresholds or limits can be established for purposes of determining occurrence of drill rod addition and removal events and for purposes of providing an accurate tally of drill rods added to and removed from a drill string 112, in accordance with various embodiments, as is coordinated by a controller 104 of the drilling machine 100.

Figure 1C:
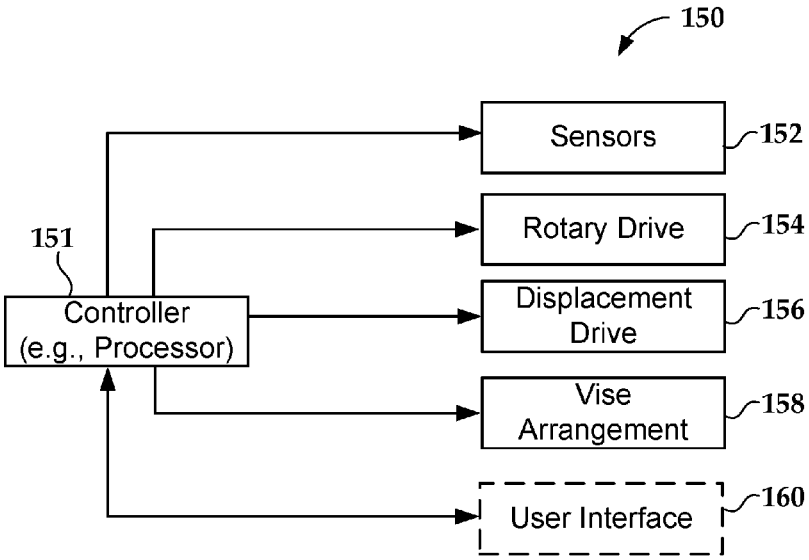
FIG. 1C is a block diagram of various components of a system for accurately tallying drill rods added to and removed from a drill string in accordance with various embodiments.

FIG. 1C is a block diagram of various components of a system for accurately tallying drill rods added to and removed from a drill string, in accordance with various embodiments of the disclosure. The system 150, shown in FIG. 1C, includes a controller 151, which is communicatively coupled to a number of components. The system 150 includes a number of sensors 152 provided on a drilling machine that monitor various system parameters that are assessed during rod tallying methodologies of the present disclosure. The controller 151 is communicatively coupled to the rotary drive 154, such as that shown as part of the gearbox 108 of FIG. 1B. The controller 151 is also communicatively coupled to a displacement drive 156 and a vise arrangement 158. In some embodiments, the vise arrangement 158 includes two independently controllable vises, such as an upper vise and a lower vise. According to various embodiments, rod tallying methodologies are conducted fully automatically without intervention of a human operator. In some embodiments, rod tallying methodologies are conducted semi-automatically with some intervention by a human operator. In embodiments involving some intervention by a human operator, a user interface 160 is communicatively coupled to the controller 151 and is used during rod tallying procedures, in accordance with various embodiments. The system shown in FIG. 1C can be used to implement various rod tallying methodologies disclosed herein.

Figure 2A:
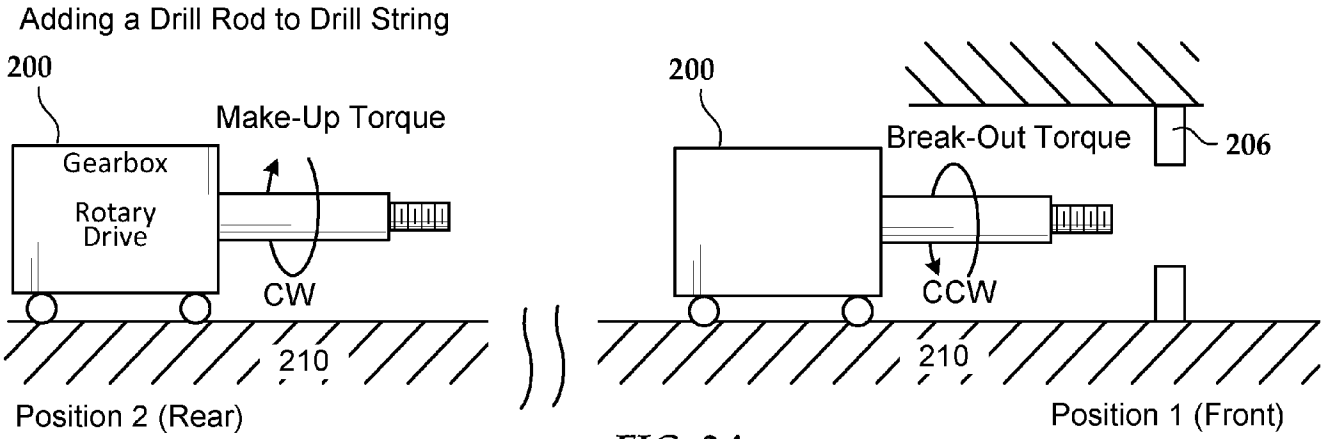
FIGS. 2A and 2B illustrate two drilling machine events that occur when adding and removing a drill rod to and from a drill string in accordance with various embodiments.
Figure 2B:
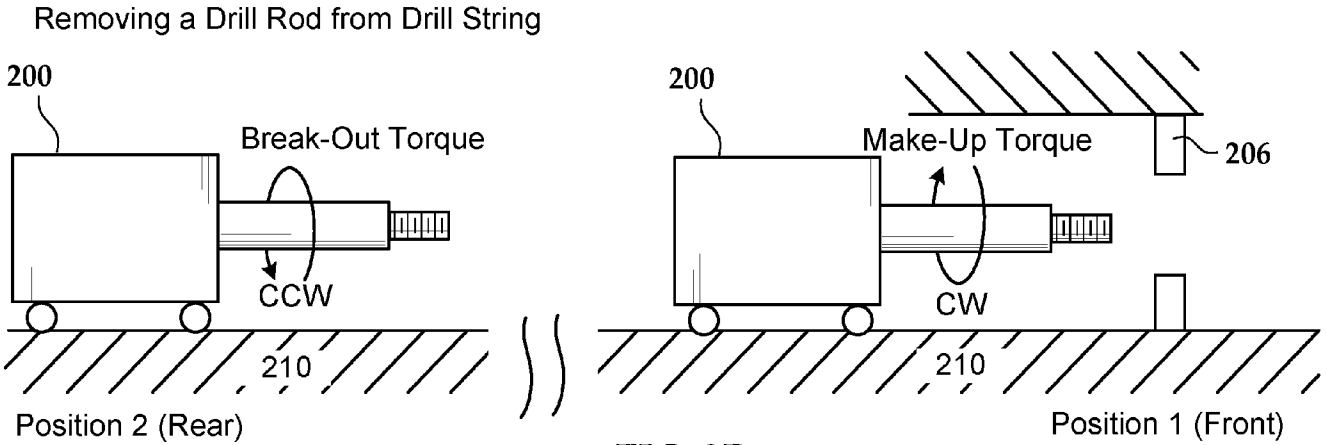

FIGS. 2A and 2B illustrate two drilling machine events that occur when adding and removing a drill rod to and from a drill string, in accordance with various embodiments. Embodiments of the disclosure are directed to monitoring the occurrence and chronological sequence of these two events, which are involved in processes for adding a drill rod to, and removing a drill rod from, a drill string. The processes shown in FIG. 2A are implemented and monitored under processor control when adding a drill rod to a drill string and incrementing a rod tally in response to addition of the drill rod. The processes shown in FIG. 2B are implemented and monitored under processor control when removing a drill rod from a drill string and decrementing a rod tally in response to removal of the drill rod.

It has been determined after significant experimentation that maintaining an accurate count of drill rods added to and removed from a drill string can be achieved by monitoring two specific drilling machine events and the concordant sequence of these events, referred to herein as a make-up event and a break-out event. A make-up torque represents a predetermined amount of torque produced by the rotary drive 200 that is needed to properly connect a drill rod (or the rotary drive itself) to a drill string. A break-out torque represents a predetermined amount of torque produced by the rotary drive 200 that is needed to disconnect a drill rod (or the rotary drive itself) from a drill string. It is further understood by those in the drilling industry that not applying the proper make-up torque has an adverse impact, in that the subsequent breakout torque can be unpredictable. In the embodiments illustrated in the present disclosure, make-up torque can be achieved by the rotary drive 200 rotating in a clockwise (CW) direction, while break-out torque can be achieved by the rotary drive 200 rotating in a counterclockwise (CCW) direction. By monitoring the occurrence, sequence, and location of these two drilling machine events, the controller of the drilling machine can determine whether a drill rod has been added to or removed from the drill string with near-absolute accuracy.

According to various embodiments, a processor of a drilling machine can be implemented to accurately determine whether a drill rod has been added to or removed from the drill string by (1) monitoring the location of the rack 210 where the rotary drive 200 generates a make-up torque and a break-out torque, and (2) the chronological sequence in which the make-up and break-out events occur. With reference to FIG. 2A, a processor of a drilling machine can automatically and accurately determine that a drill rod has been added to a drill string by detecting the occurrence of a make-up torque produced by the rotary drive 200 at a rear position (position 2) of the rack 210, which is at a position near the propulsion apparatus of the drilling machine. That action is followed by the occurrence of a break-out torque produced by the rotary drive 200 at a front position (position 1) of the rack 210, which is at a position near the vise arrangement 206 of the drilling machine. With reference to FIG. 2B, a processor of a drilling machine can automatically and accurately determine that a drill rod has been removed from the drill string by detecting the occurrence of a break-out torque produced by the rotary drive 200 at the rear position (position 2) of the rack 210, followed by the occurrence of a make-up torque produced by the rotary drive 200 at the front position (position 1).

Figures 2, 2C:
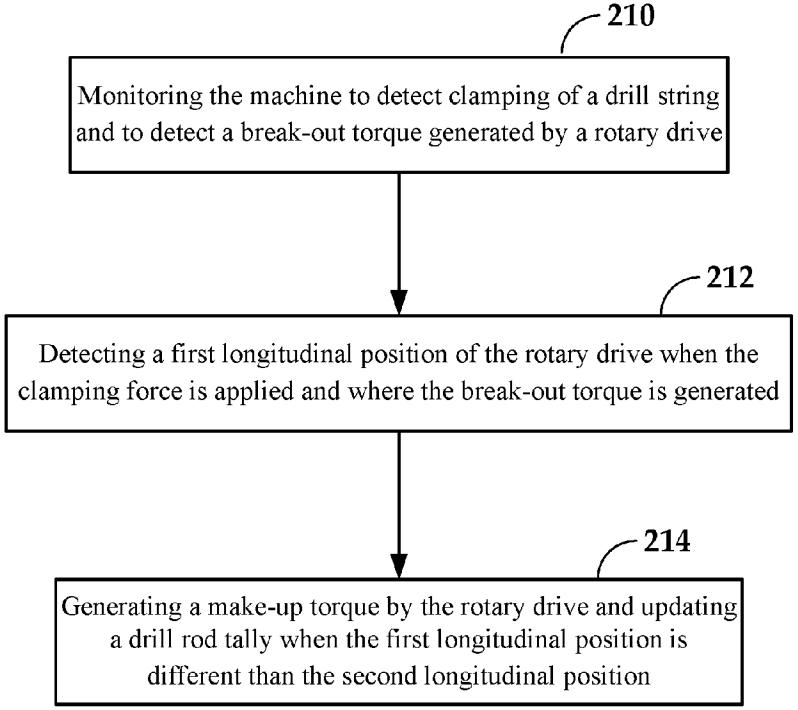
FIGS. 2C-1 and 2C-2 illustrate methods of performing an accurate rod tally operation in accordance with various embodiments.
Figures 1, 2C:
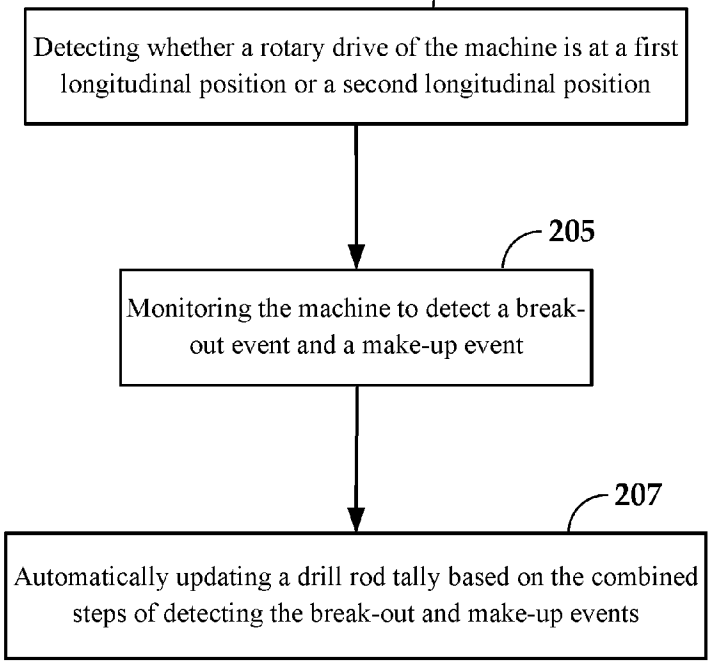

FIGS. 2C-1 and 2C-2 illustrate methods of performing an accurate rod tally operation, in accordance with various embodiments. The embodiment shown in FIG. 2C-1 involves the step of detecting 203 whether a rotary drive of a drilling machine is at a first longitudinal position or a second longitudinal position. The method shown in FIG. 2C-1 also involves the step of monitoring 205 the machine to detect a break-out event and a make-up event. The method of FIG. 2C-1 further involves the step of automatically updating a drill rod tally based on detecting a combination of the break-out and make-up events. In some embodiments, automatically updating the drill rod tally is based on detecting a combination of the break-out and make-up events and detecting positions at which the break-out and make-up events occurred. In other embodiments, automatically updating the drill rod tally is based on detecting a combination of the break-out and make-up events, detecting positions at which the break-out and make-up events occurred, and a chronological order of the break-out and make-up events.

The embodiment shown in FIG. 2C-2 involves a step of monitoring 210 a drilling machine to detect clamping of a drill string and to detect a break-out torque generated by a rotary drive of the drilling machine. The method of FIG. 2C further involves a step of detecting 212 a first longitudinal position of the rotary drive when the clamping force is applied and where the break-out torque is generated. The embodiment of FIG. 2C also involves a step of generating 214 a make-of torque by the rotary drive and then updating a drill rod tally when the first longitudinal position is different from the second longitudinal position.

In some embodiments, the make-up torque is detected automatically by one or more sensors of the drilling machine. For example, an interlock arrangement involving a vise apparatus of the drilling machine can be implemented to prevent a drill rod or the drill string from rotating until the make-up torque has been generated. Detecting whether the make-up torque has been generated can be determined by comparing the torque generated by the rotary drive to a predetermined make-up torque threshold. The interlock arrangement can be implemented to release the drill rod or drill string in response to the generated torque reaching or exceeding the predetermined make-up torque threshold.

In other embodiments, the make-up torque is detected semi-automatically by one or more sensors of the drilling machine and with human operator intervention. For example, the drilling machine can include an interface with a display and/or a speaker that generates a visual and/or aural indication that the predetermined make-up torque threshold has been reached. In response to the visual and/or aural indication that the predetermined make-up torque threshold has been reached, the operator can actuate a switch or control that releases the clamping force applied to the drill rod or the drill string.

Figure 2D:
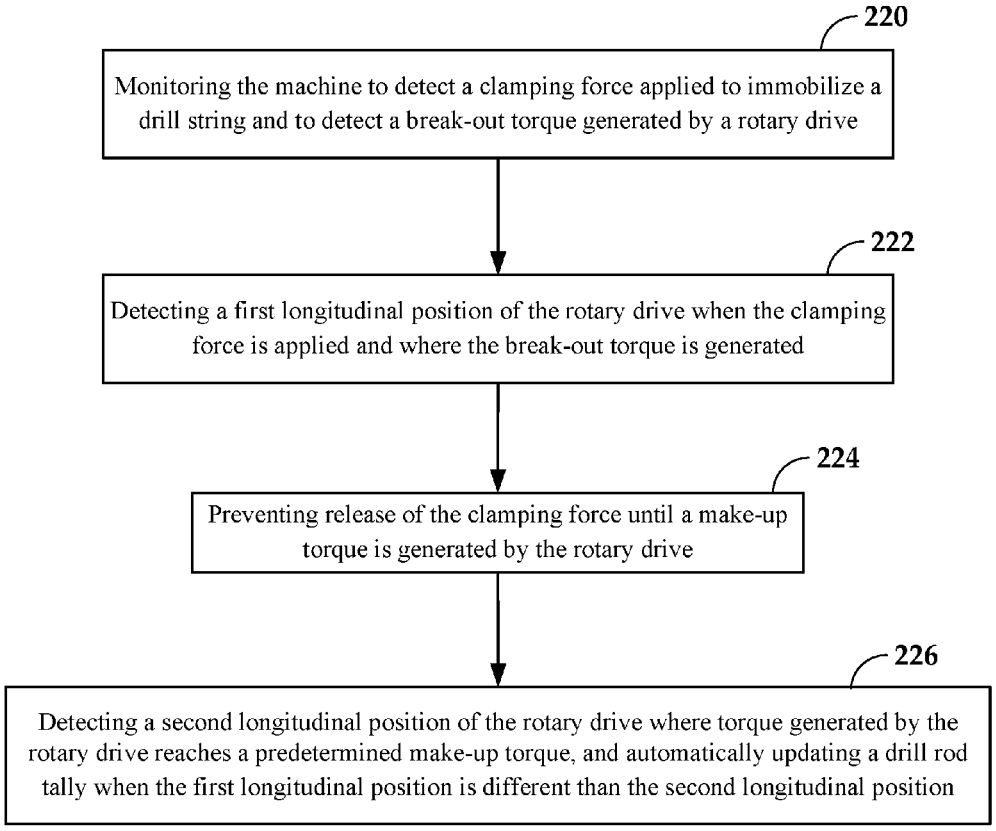
FIGS. 2D-2G illustrate various methods of performing an accurate rod tally operation in accordance with other embodiments.

FIG. 2D illustrates a method of performing an accurate rod tally operation, in accordance with other embodiments. The embodiment illustrated in FIG. 2D involves the step of monitoring 220 the drilling machine to detect the clamping force applied to immobilize a drill string and to detect a break-out torque generated by a rotary drive of the drilling machine. The embodiment of FIG. 2D also involves the step of detecting 222 a first longitudinal position of the rotary drive when the clamping force is applied and at which the break-out torque is generated. The method shown in FIG. 2D further involves the step of preventing 224 release of the clamping force until a make-up torque is generated by the rotary drive. The method also involves the step of detecting 226 a second longitudinal position of the rotary drive at which the torque generated by the rotary drive reaches a predetermined make-up torque, and automatically updating a drill rod tally when the first longitudinal position is different than the second longitudinal position.

Figure 2E:
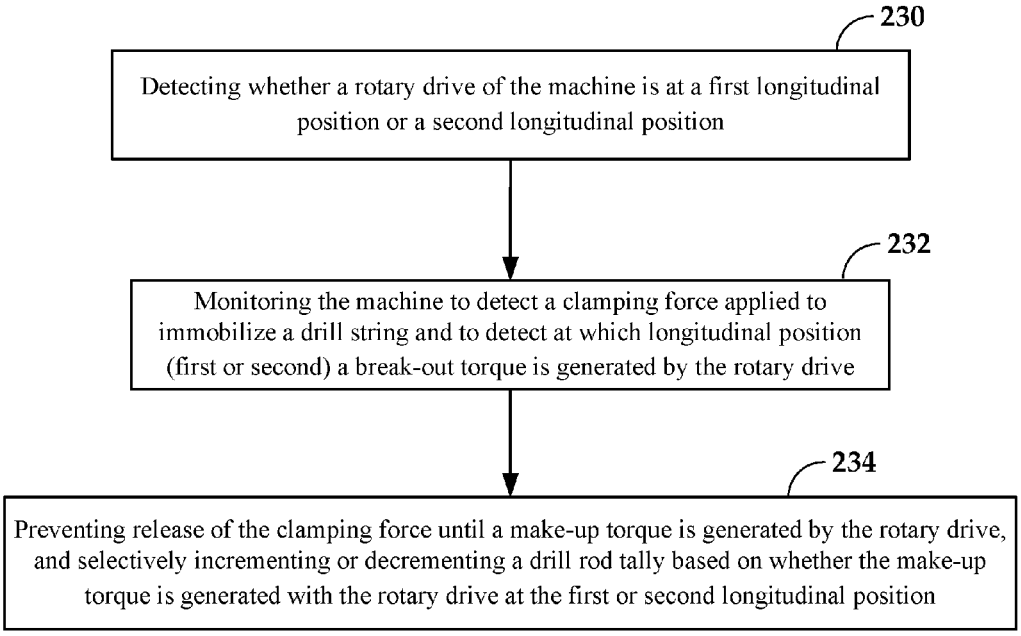

FIG. 2E illustrates a method of performing an accurate rod tally operation, in accordance with further embodiments of the disclosure. The embodiment shown in FIG. 2E involves the step of detecting 230 whether the rotary drive of the drilling machine is at a first longitudinal position or a second longitudinal position. The embodiment illustrated in FIG. 2E also involves the step of monitoring 232 the machine to detect the clamping force applied to immobilize a drill string and to detect the longitudinal position (first or second) at which a break-out torque is generated by the rotary drive. The method of FIG. 2E further involves the step of preventing 234 release of the clamping force until a make-up torque is generated by the rotary drive, and selectively incrementing or decrementing a drill rod tally based on whether the make-up torque is generated with the rotary drive at the first or second longitudinal position.

Figure 2F:
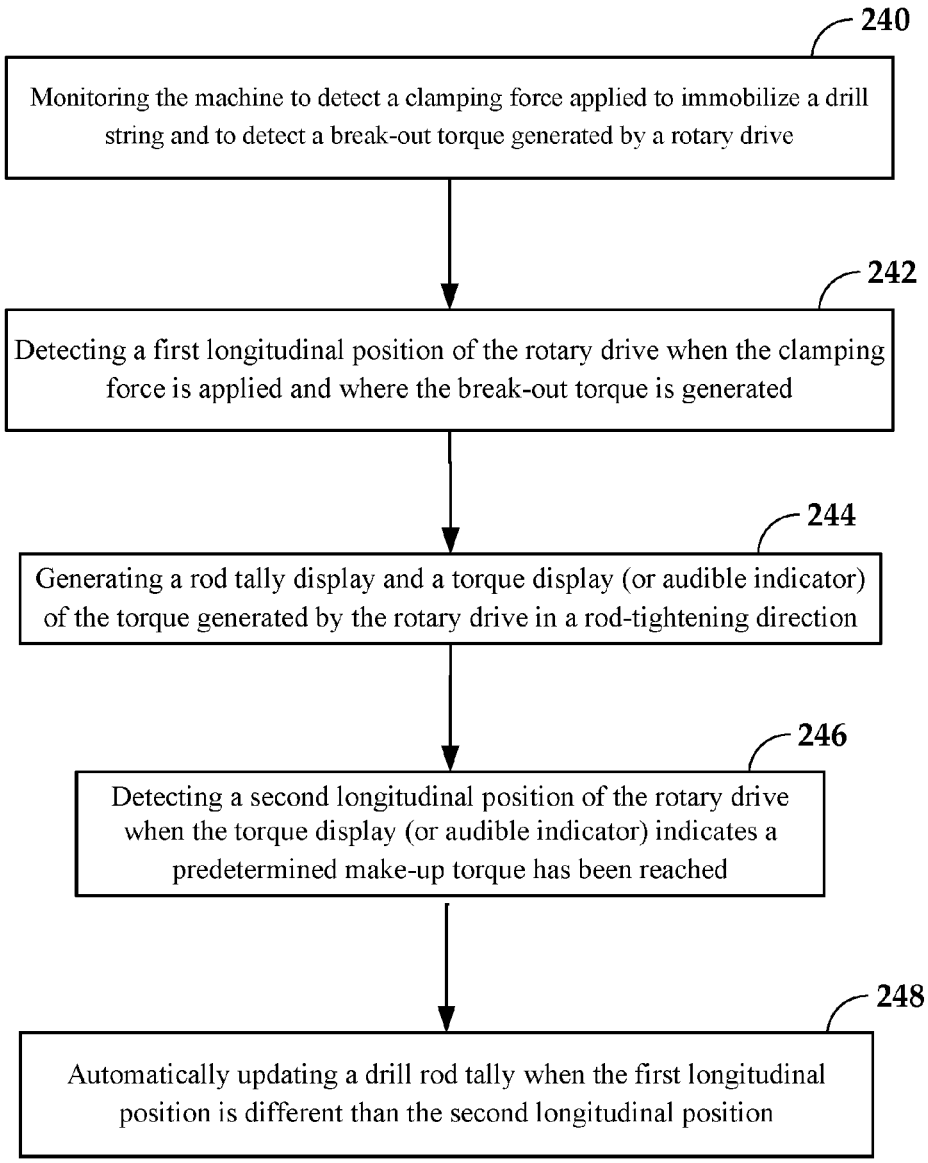

FIG. 2F illustrates a method of performing an accurate rod tally operation, in accordance with other embodiments. The embodiment shown in FIG. 2F involves the step of monitoring 240 the drilling machine to detect a clamping force applied to immobilize a drill string and to detect a break-out torque generated by a rotary drive of the drilling machine. The method illustrated in FIG. 2F also involves the step of detecting 242 the first longitudinal position of the rotary drive when the clamping force is applied and where the break-out torque is generated. The method further involves the step of generating 244 a rod tally display and a torque display (or audible indicator) of the torque generated by the rotary drive in a rod-tightening direction. The method of FIG. 2F further involves the step of detecting 246 the second longitudinal position of the rotary drive at which a predetermined make-up torque has been reached, with the occurrence of the make-up torque being detected and indicated on the torque display and/or via an audible indicator. The method shown in FIG. 2F also involves the step of automatically updating 248 a drill rod tally when the first longitudinal position is different than the second longitudinal position.

Figure 2G:
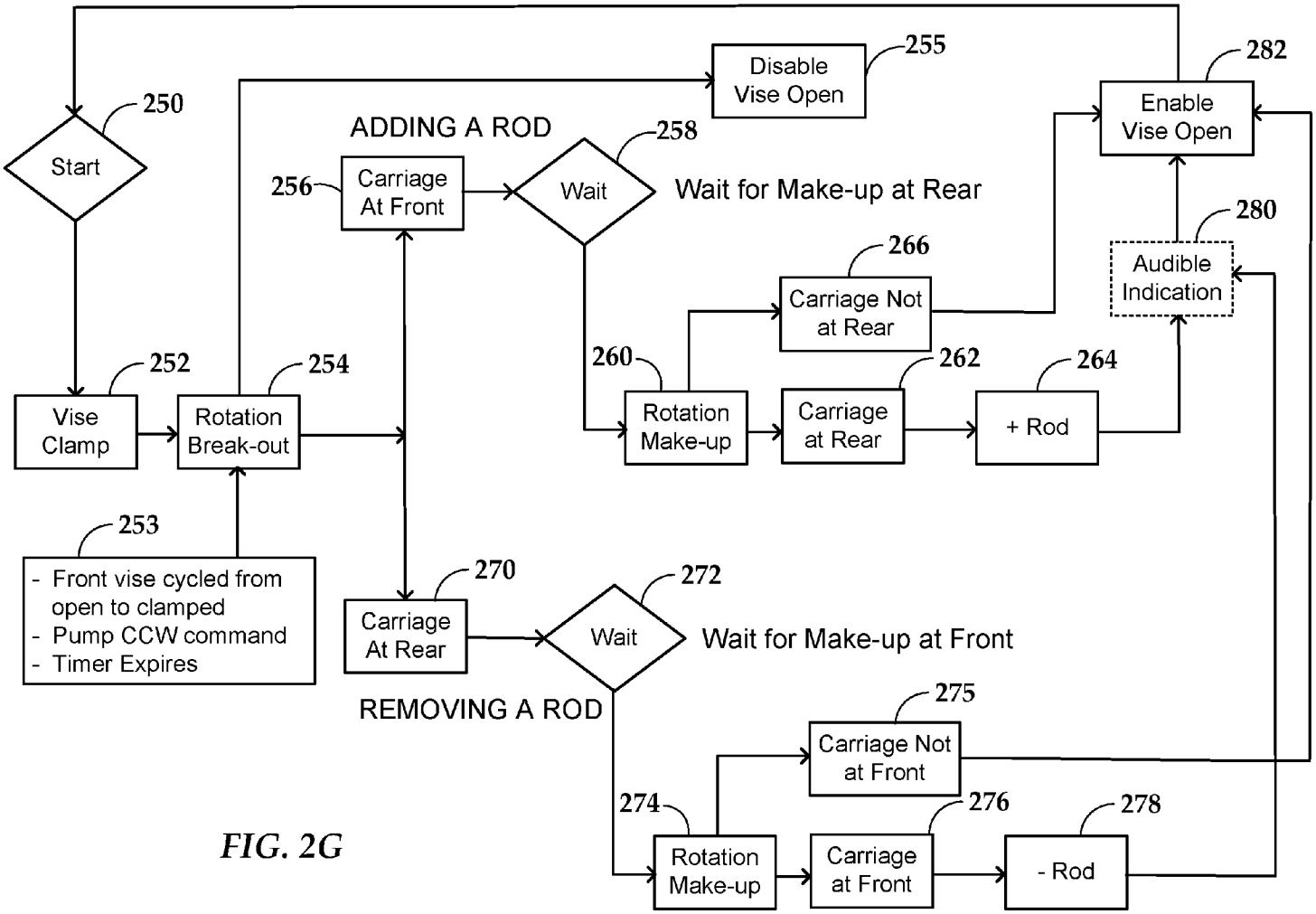

Turning now to FIG. 2G, there is illustrated a method of performing an accurate rod tally operation, in accordance with various embodiments. In accordance with the embodiment shown in FIG. 2G, the methodology is initiated by a step of activating of a vise clamp 252 followed by a rotation break-out event 254. The steps of activating the vise clamp 252 and the occurrence of the rotation break-out event 254 can include a number of operations 253, including cycling a front vise of the vise apparatus from open to clamped, issuing a counterclockwise (CCW) command to a pump that powers the break-out rotation and possibly expiration of a timer, if applicable. Depending on the rack location at which the break-out rotation step 254 occurs, the next operation can involve adding a rod to the drill string or removing a rod from the drill string. For either of these two operations, an interlock mechanism can be activated to disable opening, indicated as step 255, of the vise, such as, for example, until a predetermined make-up torque is subsequently detected. In some embodiments, an interlock mechanism is not employed, and opening of the vise is enabled via operator intervention.

Adding a rod to the drill string involves performing a break-out rotation step 254 when the carriage to which the rotary drive is mounted is situated at a front position 256, which is adjacent the vise apparatus of the drilling machine. Performing the break-out rotation step 254 at the front position 256 decouples the rotary drive from the drill string. A wait period 258 ensues to allow the carriage to move longitudinally from the front position 256 to a rear position adjacent the propulsion apparatus of the drilling machine. It is noted that the front position 256 is spaced apart from the rear position by a distance of at least one drill rod length. With the carriage situated at the rear position, a new drill rod is positioned in proximity with the rotary drive of the carriage. A rotation make-up operation 260 is performed, resulting in rotational coupling between the rotary drive and the new drill rod. According to embodiments that employ an interlock implementation, the new drill rod is rotationally immobilized until a predetermined make-up torque is reached.

A check is made to determine whether or not the carriage is at the rear position following the step of generating the make-up torque 260 by the rotary drive. If it is determined that the carriage is indeed at the rear position 262, the current rod tally is incremented by one rod count 264; an audible or other indication of the successful rod count increment event is indicated 280 (optional); the vise clamp holding the new drill rod is open 282; and the process initiated at start 250 is repeated. If, however, it is determined that the carriage is not at the rear position 266, no change to the rod tally is made; the vise clamp holding the new drill rod is opened 282; and the process initiated at start 250 is repeated.

Removing a rod from the drill string involves performing a break-out rotation step 254, with the carriage to which the rotary drive is mounted being situated at a rear position 270. That rear position 270 is adjacent the propulsion apparatus of the drilling machine. Performing the break-out rotation step 254 at the rear position 270 decouples a drill rod (presently decoupled from the drill string but still connected to the rotary drive) from the rotary drive. A wait period, as indicated by 272, ensues to allow the carriage to move longitudinally from the rear position 270 to the front position adjacent the vise arrangement. With the carriage situated at the front position, the rotary drive is threaded onto the drill string. A rotation make-up operation 274 is performed, resulting in rotational coupling between the rotary drive and the drill string. According to embodiments that employ an interlock implementation, the rotary drive threads a given drill rod onto the drill string with increasing torque until a predetermined make-up torque is reached.

A check is made to determine whether or not the carriage is at the front position following generation of the make-up torque 274 by the rotary drive. If it is determined that the carriage is at the front position 276, the current rod tally is decremented by one rod count 278; an audible or other indication 280 of the successful rod count being decremented may be indicated (optional); the vise clamp holding the drill rod to be removed is open (i.e., vise clamp opening step 282); and the process initiated at start 250 is repeated. If, however, it is determined that the carriage is not at the front position 275, no change to the rod tally is made, the vise clamp holding the drill rod to be removed is opened, as indicated at the vise clamp opening step 282, and the process initiated at start 250 is repeated.

Turning now to FIGS. 3-22, there is illustrated various states of a drilling machine during a rod tallying operation, in accordance with various embodiments. FIGS. 3-10 illustrate various states of a drilling machine when adding a drill rod to a drill string, according to various embodiments. FIGS. 11-22 illustrate various states of the drilling machine when removing a drill rod from a drill string, in accordance with various embodiments.

Figure 3:
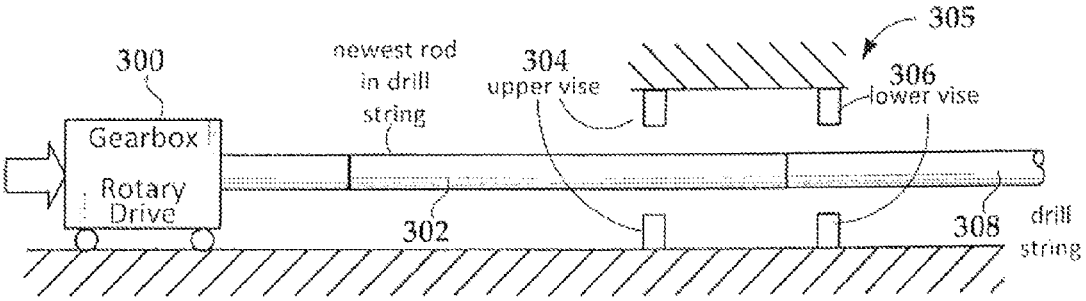
FIGS. 3-10 illustrate various states of a drilling machine when adding a drill rod to a drill string according to various embodiments.
Figure 4:
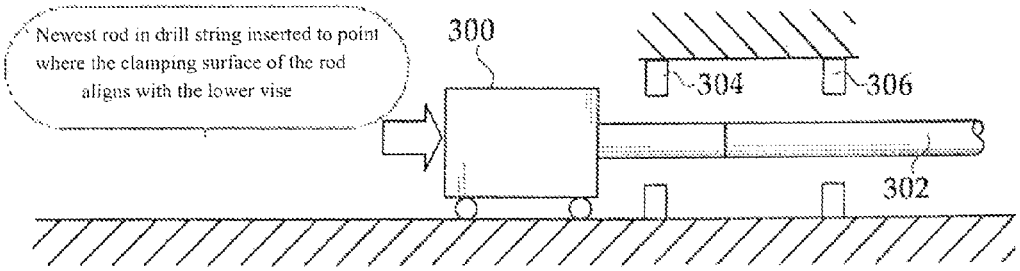
Figure 5:
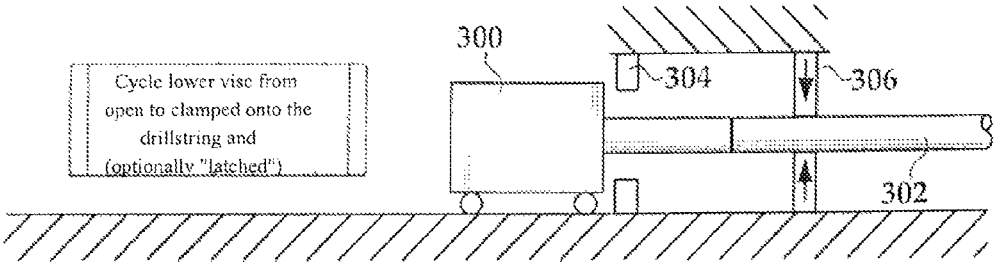

FIG. 3 illustrates an initial event at the beginning of a rod addition operation, in which a new drill rod 302 has been added to a drill string 308, and the rotary drive 300 (also referred to herein generally as a gearbox) is thrusted longitudinally toward a vise arrangement 305, thereby advancing the drill string into the earth by an additional length equivalent to that of the newly added drill rod 302. In the embodiments depicted in FIGS. 3-22, the vise arrangement 305 includes an upper vise 304 (biased toward the propulsion apparatus of the drilling machine) and a lower vise 306 (biased further away from the propulsion apparatus). When longitudinally thrusting the drill string 308 into the ground, the newest rod 302 added to the drill string 308 is advanced to the point where the clamping surface of the newly added drill rod aligns with the lower vise 306, which is shown in FIG. 4. The lower vise 306 is cycled from an open configuration to a clamped configuration so that the newly added drill rod 302 is rotationally immobilized, as is shown in FIG. 5. In accordance with embodiments involving "latching" of a drill rod, releasing of the lower vise 306 from the drill rod 302 is prevented by an interlock arrangement until such time as a predetermined makeup-up torque is generated by the rotary drive 300.

Figure 6:
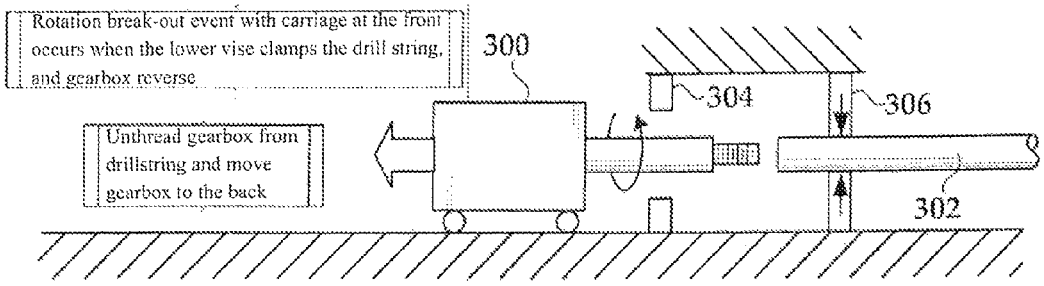
Figure 7:
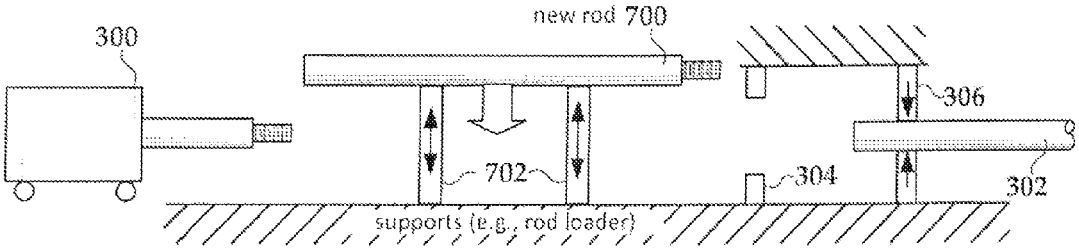

With the drill rod 302 rotationally immobilized by the lower vise 306, a rotation break-out event occurs with the rotary drive 300 situated at the front position, whereby the rotary drive 300 reverse rotates to break the joint between the drill rod 302 and the rotary drive 300. In some embodiments, and as is shown in FIG. 6, completion of the break-out event is based on expiration of a predetermined period of time (e.g., >2 seconds, such as 3, 4 or 5 seconds) during which the rotary drive 300 is driven in a counter-clockwise (CCW) direction. In other embodiments, break-out torque produced by the rotary drive 300 is monitored and increased until a torque greater than the torque used to create the joint between the drill rod 302 and the rotary drive 300 (e.g., make-up torque) is reached. Following the rotation break-out event, the rotary drive is unthreaded from the drill rod 302 (now part of the drill string 308) and is moved longitudinally from the front position to the rear position. With the rotary drive 300 being located at the rear position, a gap is created between the rotary drive 300 and the proximal end of the drill string 302, as is shown in FIG. 7. The gap has a length at least equal to, and preferably longer than, that of a new drill rod 700 to be added to the drill string 302. A rod loader arrangement 702 can be activated to provide support for the new drill rod 700 to be added to the drill string 302. The rod loader 702 serves to properly align the new drill rod 700 with the threads of the rotary drive 300 and those of the proximal end of the drill string 302. It is understood that the rod loader arrangement 702 is an optional component that can be included or excluded. Some embodiments may include a rod loader 702, while other embodiments do not. Other embodiments employ a separate machine(s) for lifting and moving the drill rods. In general, rod loader operation does not play a part in drill rod counting and updating operations.

Figure 8:
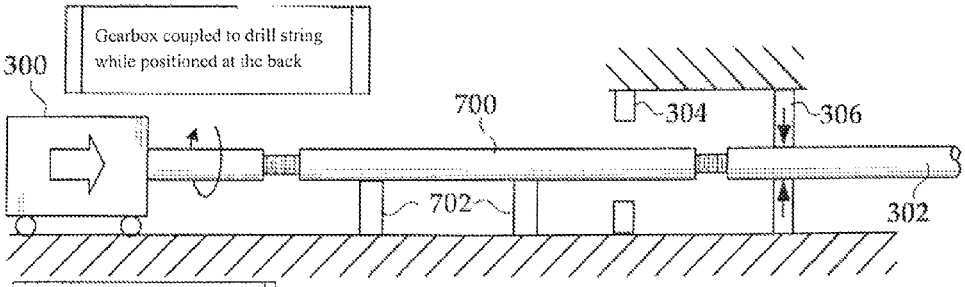
Figure 9:
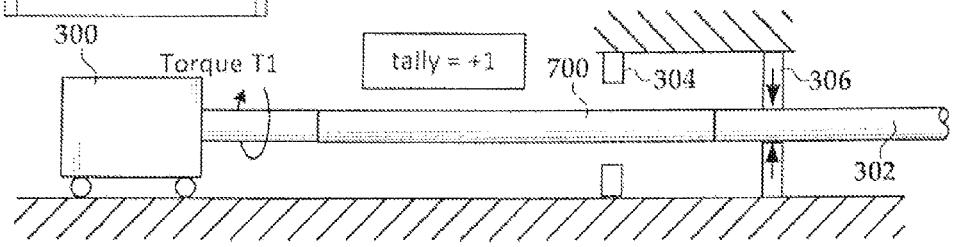
Figure 10:
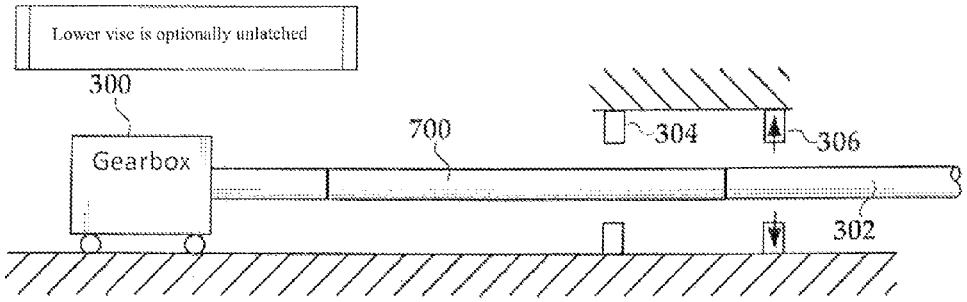

As can be seen in FIG. 7, the lower vise 306 continues to exert clamping pressure on the clamping surface of the drill string 302, thereby rotationally immobilizing the drill string 302 during the rod addition operation. With the new drill rod 700 properly aligned via the rod loader 702, the new drill rod 700 is threaded onto the rotary drive 300 and onto the drill string 302, as is shown in FIG. 8. The rotary drive 300 generates torque when threading the new drill rod 700 onto the drill string 302 until a predetermined makeup-up torque is reached, at which point the current rod tally is incremented by one rod count, as is shown in FIG. 9. The lower vise 306 is unclamped (and unlatched in some embodiments) from the drill string 302 following detection of the make-up torque event, with the rotary drive 300 located at the rear position, as is shown in FIG. 10.

Figure 11:
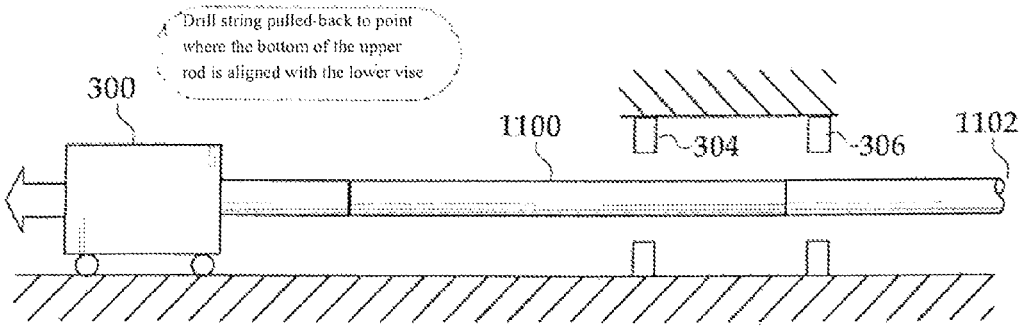
FIGS. 11-22 illustrate various states of a drilling machine when removing a drill rod from a drill string in accordance with various embodiments.
Figure 12:
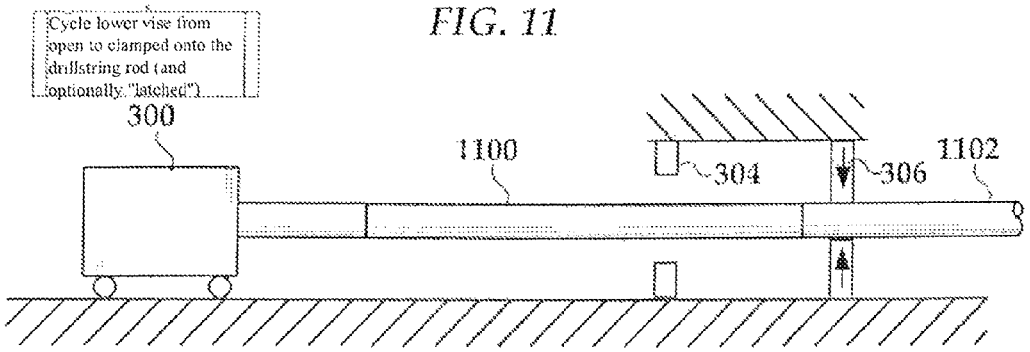
Figure 13:
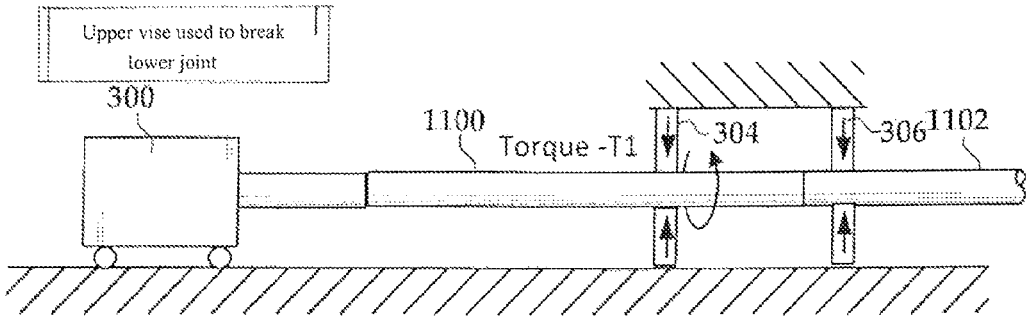
Figure 14:
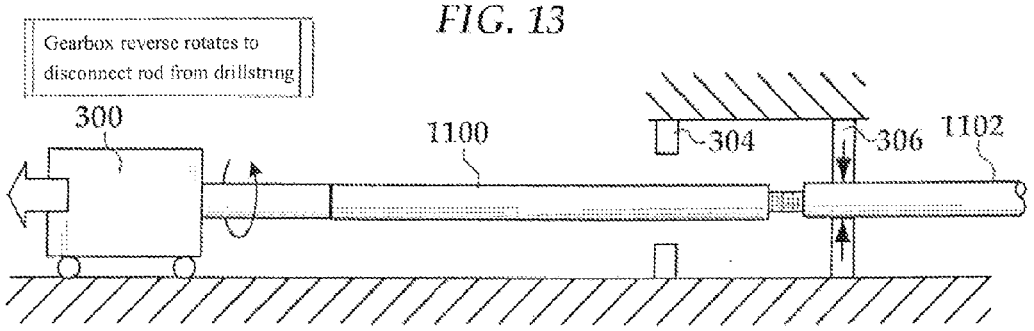

A representative process for removing a drill rod from a drill string begins when the drill string 1102 has been pulled back by the rotary drive 300 to the point where the bottom of the upper drill rod 1100 is aligned with the lower vise 306, as is shown in FIG. 11. As is best seen in FIG. 12, the lower vise 306 is cycled from an open configuration to a clamped configuration, such that the lower vise 306 clamps onto the clamping surface of the drill string 1102, adjacent the threaded joint with the upper drill rod 1100. In accordance with embodiments that employ an interlock arrangement, the drill string 1102 remains "latched" by the lower vise 306 until such time that a predetermined makeup-up torque is detected. As shown in FIG. 13, with the drill string 1102 being rotationally immobilized by the lower vise 306, the upper vise 304 is used to break the lower joint between the upper drill rod 1100 and the drill string 1102 (e.g., the breaking torque exerted on the lower joint by the upper vise 304 being greater than the make-up torque used to set the joint). The rotary drive 300 reverse rotates to disconnect the upper drill rod 1100 from the drill string 1102, as is shown in FIG. 14.

Figure 15:
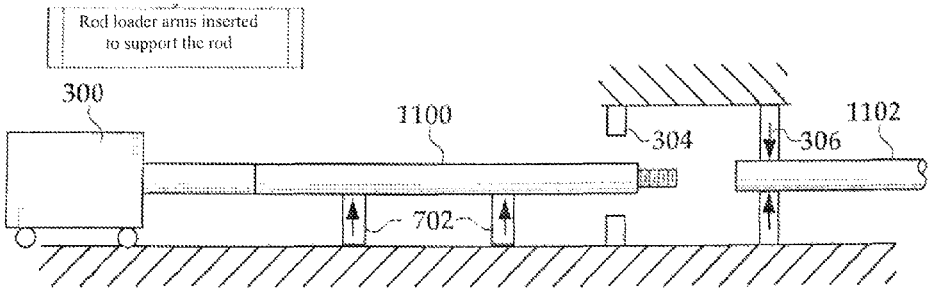
Figure 16:
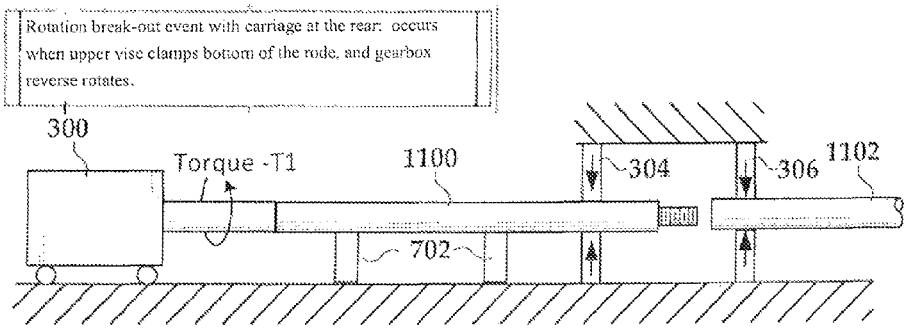
Figure 17:
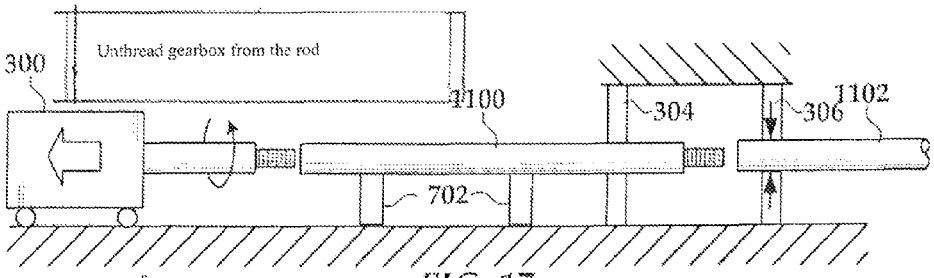
Figure 18:
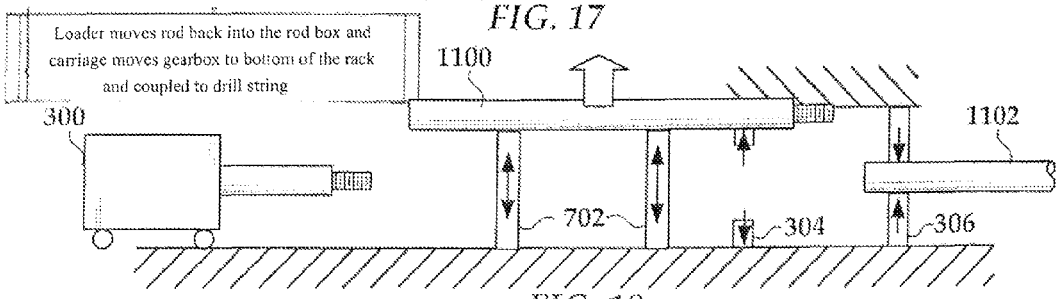
Figure 19:
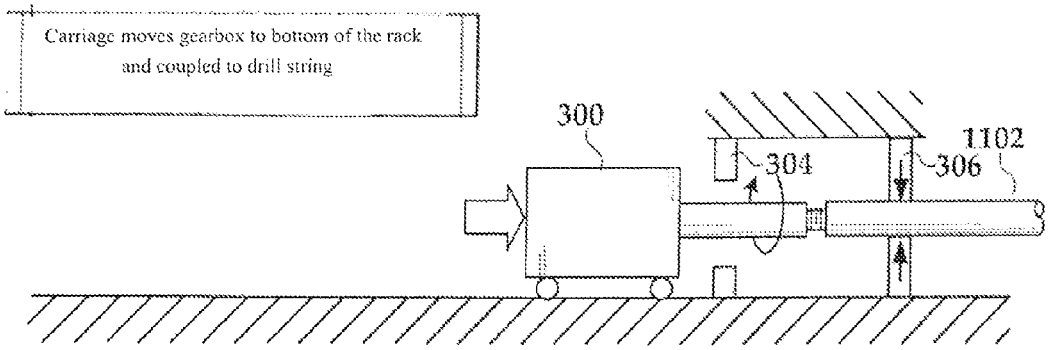

FIG. 15 shows arms of the rod loader 702 inserted to provide support for the upper drill rod 1100. The rod loader 702 provides support for the upper drill rod 1100 during subsequent steps of the rod removal procedure. It is noted that the state of the rod loader 702 typically does not impact the rod tallying procedure. As is shown in FIG. 16, with the rotary drive 300 being situated at the rear position, a rotation break-out event occurs when the upper vise 304 clamps the bottom of the drill rod 1100 and the rotary drive 300 reverse rotates for a specified duration (e.g., >2 seconds, such as 3, 4 or 5 seconds). In some embodiments, torque or pressure monitoring can alternatively be employed to detect the break-out event. The rotary drive 300 continues to reverse rotate until it is unthreaded from the drill rod 1100, as shown in FIG. 17. The rod loader 702 moves the drill rod 1100 back into the rod box, as shown in FIG. 18. The carriage then moves the rotary drive 300 longitudinally to the bottom of the rack where the rotary drive 300 couples to the drill string 1102, which has been rotationally immobilized by the lower vise 306, as shown in FIG. 19. In this configuration, the lower vise 306 may prevent rotational movement of the drill string 1102, until such time as a make-up torque is detected.

Figure 20:
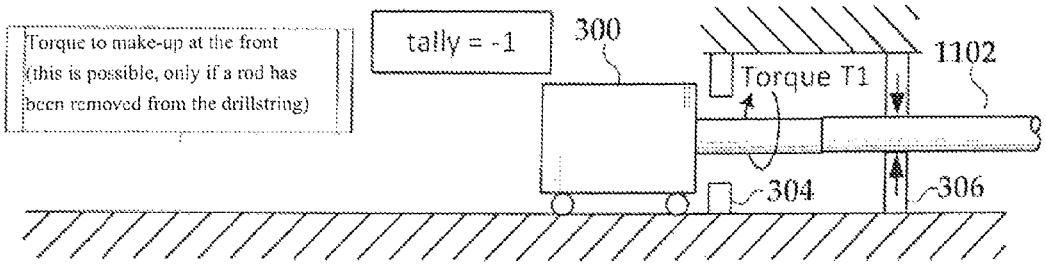
Figure 21:
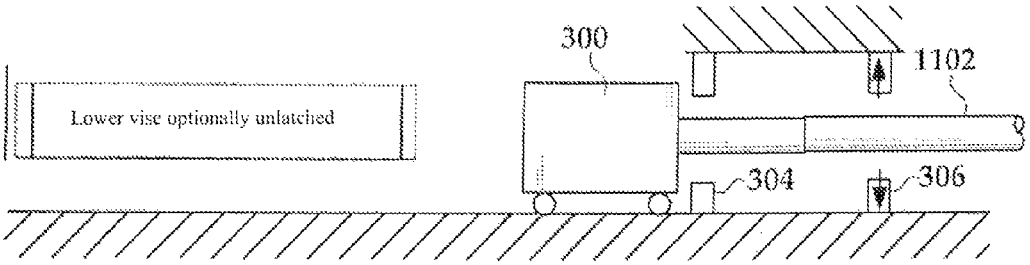
Figure 22:
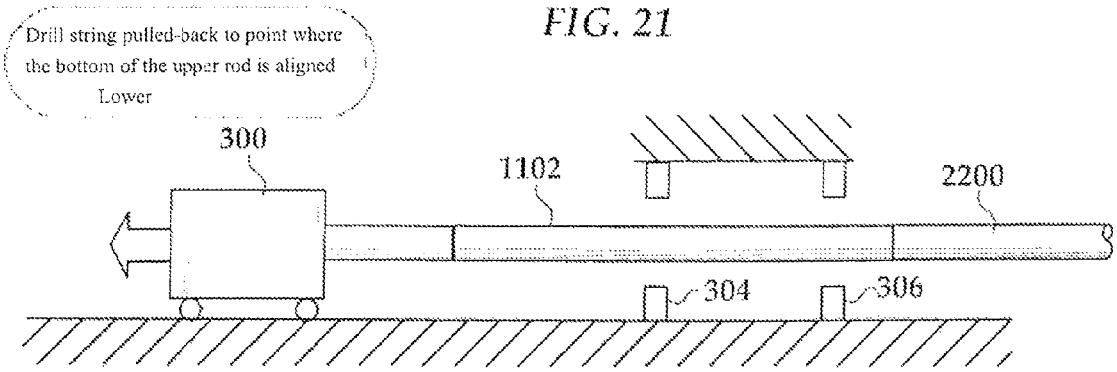

As is shown in FIG. 20, the rotary drive 300 is threaded onto the proximal end of the drill string 1102 and increases torque applied to the joint until a predetermined make-up torque is reached, at which time the rod tally is decremented by one rod count. After decrementing the rod tally by one rod count, the lower vise 1102 is optionally unlatched and, in any case, unclamps from the drill string 1102, as is shown in FIG. 21. Having now reestablished coupling between the rotary drive 300 and drill string 1102, the drill string 1102 may be pulled back to a point where the bottom of the upper rod 1102 is aligned with the lower vise 306. It can be seen in FIG. 22 that the upper rod 1102, shown connected to the rest of the drill string of 2200, can now be manipulated in a manner described hereinabove for purposes of removing the upper rod 1102 from the drill string 2200.

The discussion and illustrations provided herein are presented in an exemplary format, wherein selected embodiments are described and illustrated to present the various aspects of the present invention. Systems, devices, or methods according to the present invention may include one or more of the features, structures, methods, or combinations thereof described herein. For example, a device or system may be implemented to include one or more of the advantageous features and/or processes described below. A device or system according to the present invention may be implemented to include multiple features and/or aspects illustrated and/or discussed in separate examples and/or illustrations. It is intended that such a device or system need not include all of the features described herein, but may be implemented to include selected features that provide for useful structures, systems, and/or functionality.

Although only examples of certain functions may be described as being performed by circuitry for the sake of brevity, any of the functions, methods, and techniques can be performed using circuitry and methods described herein, as would be understood by one of ordinary skill in the art.

Systems, devices or methods disclosed herein may include one or more of the features structures, methods, or combination thereof described herein. For example, a system or method may be implemented to include one or more of the features and/or processes above. It is intended that such system or method need not include all of the features and/or processes described herein, but may be implemented to include selected features and/or processes that provide useful structures and/or functionality. Various modifications and additions can be made to the disclosed embodiments discussed above. Accordingly, the scope of the present disclosure should not be limited by the particular embodiments described above, but should be defined only by the claims set forth below and equivalents thereof.

What is claimed is:

1. A method of drilling and automatically tallying drill rods for use with a drilling machine, the method comprising:

performing, in response to manual input from an operator, a drilling operation using the drilling machine; and while performing the drilling operation, automatically tallying the drill rods of a drill string coupled to a rotary drive of the drilling machine by:

monitoring the machine to detect a clamping force applied to immobilize the drill string and to detect a break-out torque generated by the rotary drive;

detecting a first longitudinal position of the rotary drive at which the clamping force is applied and the break-out torque or a make-up torque is generated;

preventing release of the clamping force until the make-up torque is generated by the rotary drive;

detecting a second longitudinal position of the rotary drive at which the make-up torque or the break-out torque is generated by the rotary drive; and automatically allowing release of the clamping force after the make-up torque is generated by the rotary drive and updating a drill rod tally when the first longitudinal position is different than the second longitudinal position.

2. The method of claim 1, wherein automatically updating the drill rod tally comprises detecting that the break-out torque is generated by the rotary drive at one of the first and second longitudinal positions and that the make-up torque is generated by the rotary drive at the other of the first and second longitudinal positions.

3. The method of claim 1, wherein automatically updating the drill rod tally comprises:

detecting that the break-out torque is generated by the rotary drive at one of the first and second longitudinal positions and detecting that the make-up torque is generated by the rotary drive at the other of the first and second longitudinal positions; and detecting that the clamping force is automatically allowed to release after the make-up torque is generated by the rotary drive.

4. The method of claim 1, wherein:

the first longitudinal position is a distal position proximate a location where the drill string enters the ground; and the second longitudinal position is proximal of, and spaced apart from, the first longitudinal position by at least a distance equal to a length of a drill rod.

5. The method of claim 4, wherein automatically updating the drill rod tally comprises:

incrementing the drill rod tally by one count in response to the combined steps of the rotary drive generating the break-out torque at the first longitudinal position and the rotary drive generating the make-up torque at the second longitudinal position.

6. The method of claim 4, wherein automatically updating the drill rod tally comprises:

decrementing the drill rod tally by one count in response to the combined steps of the rotary drive generating the break-out torque at the second longitudinal position and the rotary drive generating the make-up torque at the first longitudinal position.

7. The method of claim 1, further comprising generating a human-perceivable indication of a change to the drill rod tally.

* * * * *